United States Patent [19]

Young et al.

[11] Patent Number: 4,790,884

[45] Date of Patent: Dec. 13, 1988

[54] ALUMINUM-LITHIUM FLAT ROLLED PRODUCT AND METHOD OF MAKING

[75] Inventors: Kenton P. Young, Plum Boro; Edward L. Colvin, Monroeville, both of Pa.; Joel A. Bowers; Robert W. Westerlund, both of Bettendorf, Iowa

[73] Assignee: Aluminum Company of America, Pittsburgh, Pa.

[21] Appl. No.: 20,600

[22] Filed: Mar. 2, 1987

[51] Int. Cl.[4] ..... C22F 1/04

[52] U.S. Cl. ..... 148/2; 148/12.7 A; 148/415; 148/416; 148/417

[58] Field of Search ..... 148/12.7 A, 2, 415–418

[56] References Cited

U.S. PATENT DOCUMENTS 4,648,913 3/1987 Hunt, Jr. et al. ..... 148/12.7 A

*Primary Examiner*—R. Dean

*Attorney, Agent, or Firm*—Andrew Alexander

[57] ABSTRACT

Disclosed is a method of making aluminum base alloy flat rolled product substantially free of Luder's lines after stretching, the method comprising the steps of providing a body of a lithium-containing aluminum base alloy and working the body to produce a flat rolled product prior to solution heat treating and quenching. The flat rolled product is preaged for a time and temperature which does not substantially affect mechanical properties but which permits stretching the flat rolled product without formation of Luder's lines. Thereafter, the preage flat rolled product is stretched and aged to a condition having a substantially stable level of mechanical properties.

20 Claims, No Drawings

ALUMINUM-LITHIUM FLAT ROLLED PRODUCT AND METHOD OF MAKING

BACKGROUND OF THE INVENTION

This invention relates to aluminum base alloy products, and more particularly, it relates to an improved lithium-containing aluminum alloy flat rolled product and a method of producing the same.

In the aircraft industry, it has been generally recognized that one of the most effective ways to reduce the weight of an aircraft is to reduce the density of aluminum alloys used in the aircraft construction. For purposes of reducing the alloy density, lithium additions have been made. However, the addition of lithium to aluminum alloys is not without problems. For example, the addition of lithium to aluminum alloys often results in a decrease in ductility and fracture toughness. Where the use is in aircraft parts, it is imperative that the lithium-containing alloy have both improved fracture toughness and strength properties.

It will be appreciated that both high strength and high fracture toughness appear to be quite difficult to obtain when viewed in light of conventional alloys such as AA (Aluminum Association) 2024-T3X and 7050-TX normally used in aircraft applications. For example, a paper by J. T. Staley entitled "Microstructure and Toughness of High-Strength Aluminum Alloys", Properties Related to Fracture Toughness, ASTM STP605, American Society for Testing and Materials, 1976, pp. 71–103, shows generally that for AA2024 sheet, toughness decreases as strength increases. Also, in the same paper, it will be observed that the same is true of AA7050 plate. More desirable alloys would permit increased strength with only minimal or no decrease in toughness or would permit processing steps wherein the toughness was controlled as the strength was increased in order to provide a more desirable combination of strength and toughness. Additionally, in more desirable alloys, the combination of strength and toughness would be attainable in an aluminum-lithium alloy having density reductions in the order of 5 to 15%. Such alloys would find widespread use in the aerospace industry where low weight and high strength and toughness translate to high fuel savings.

When the aluminum-lithium alloy is a flat rolled or sheet product, yet further problems occur. For example, when the sheet product is stretched, it often forms Luder's lines. Lueder's lines are lines or markings appearing on the otherwise smooth surface of metal strained beyond its elastic limit, usually as a result of a multi-directional forming operation and metal movement during that operation.

Luder's lines are objectional from an appearance standpoint. Normally, polishing does not remove the markings resulting from the formation of such lines. If the sheet product is clad, then polishing could be detrimental by making the cladding thickness nonuniform. Also, in a product having the thickness of sheet, too much polishing can affect the mechanical properties. A further problem with formation of Luder's lines is that they often occur nonuniformly. Thus, it will be appreciated that because of these problems, it is desirable to provide sheet product free of Luder's lines.

The present invention provides an improved lithium-containing aluminum base alloy flat rolled product which can be processed to provide a sheet or plate product, for example, which is substantially free of Luder's lines after stretching.

SUMMARY OF THE INVENTION

A principal object of this invention is to provide an improved lithium-containing aluminum base alloy flat rolled product.

Yet another object of this invention is to provide an aluminum-lithium alloy flat rolled product capable of being stretched without formation of Luder's lines.

And yet another object of this invention includes a method of providing a wrought aluminum-lithium alloy flat rolled product which may be stretched prior to aging without formation of Luder's lines.

These and other objects will become apparent from the specification, drawings and claims appended hereto.

A method of making aluminum base alloy flat rolled product substantially free of Luder's lines after stretching, the method comprising the steps of providing a body of a lithium-containing aluminum base alloy; working the body to produce a flat rolled product; solution heat treating and quenching the flat rolled product; preaging the product for a time and temperature which does not substantially affect mechanical properties but which permits stretching it without formation of Luder's lines; stretching the preage product; and aging the product to a condition having a substantially stable level of mechanical properties.

DETAILED DESCRIPTION OF THE PREFERRED EMBODIMENTS

The alloy of the present invention can contain 0.5 to 4.0 wt. % Li, 0 to 5.0 wt. % Mg, up to 5.0 wt. % Cu, 0 to 1.0 wt. % Zr, 0 to 2.0 wt. % Mn, 0 to 7.0 wt. % Zn, 0.5 wt. % max. Fe, 0.5 wt. % max. Si, the balance aluminum and incidental impurities. The impurities are preferably limited to about 0.05 wt. % each, and the combination of impurities preferably should not exceed 0.15 wt. %. Within these limits, it is preferred that the sum total of all impurities does not exceed 0.35 wt. %.

A preferred alloy in accordance with the present invention can contain 1.0 to 4.0 wt. % Li, 0.1 to 5.0 wt. % Cu, 0 to 5.0 wt. % Mg, 0 to 1.0 wt. % Zr, 0 to 2 wt. % Mn, the balance aluminum and impurities as specified above. A typical alloy composition would contain 2.0 to 3.0 wt. % Li, 0.5 to 4.0 wt. % Cu, 0 to 3.0 wt. % Mg, 0 to 0.2 wt. % Zr, 0 to 1.0 wt. % Mn and max. 0.1 wt. % of each of Fe and Si.

In the present invention, lithium is very important not only because it permits a significant decrease in density but also because it improves tensile and yield strengths markedly as well as improving elastic modulus. Additionally, the presence of lithium improves fatigue resistance. Most significantly though, the presence of lithium in combination with other controlled amounts of alloying elements permits aluminum alloy products which can be worked to provide unique combinations of strength and fracture toughness while maintaining meaningful reductions in density. It will be appreciated that less than 0.5 wt. % Li does not provide for significant reductions in the density of the alloy and 4 wt. % Li is close to the solubility limit of lithium, depending to a significant extent on the other alloying elements. It is not presently expected that higher levels of lithium would improve the combination of toughness and strength of the alloy product.

With respect to copper, particularly in the ranges set forth hereinabove for use in accordance with the present invention, its presence enhances the properties of the alloy product by reducing the loss in fracture toughness at higher strength levels. That is, as compared to lithium, for example, in the present invention copper has the capability of providing higher combinations of toughness and strength. For example, if more additions of lithium were used to increase strength without copper, the decrease in toughness would be greater than if copper additions were used to increase strength. Thus, in the present invention when selecting an alloy, it is important in making the selection to balance both the toughness and strength desired, since both elements work together to provide toughness and strength uniquely in accordance with the present invention. It is important that the ranges referred to hereinabove, be adhered to, particularly with respect to the upper limits of copper, since excessive amounts can lead to the undesirable formation of intermetallics which can interfere with fracture toughness.

Magnesium is added or provided in this class of aluminum alloys mainly for purposes of increasing strength although it does decrease density slightly and is advantageous from that standpoint. It is important to adhere to the upper limits set forth for magnesium because excess magnesium can also lead to interference with fracture toughness, particularly through the formation of undesirable phases at grain boundaries.

The amount of manganese should also be closely controlled. Manganese is added to contribute to grain structure control, particularly in the final product. Manganese is also a dispersoid-forming element and is precipitated in small particle form by thermal treatments and has as one of its benefits a strengthening effect. Dispersoids such as $Al_{20}Cu_2Mn_3$ and $Al_2Mg_2Mn$ can be formed by manganese. Chromium can also be used for grain structure control but on a less preferred basis. Zirconium is the preferred material for grain structure control. The use of zinc results in increased levels of strength, particularly in combination with magnesium. However, excessive amounts of zinc can impair toughness through the formation of intermetallic phases.

Aluminum-lithium clad products may be processed in accordance with the invention. Such clad products utilize a core of a lithium-containing aluminum base alloy and a cladding of higher purity alloy which protects the core. The cladding on the core may be selected from Aluminum Association alloys 1100, 1200, 1230, 1135, 1235, 1435, 1145, 1345, 1250, 1350, 1170, 1175, 1180, 1185, 1285, 1188, 1199 or 7072. The core material can be AA 2090 or 2091.

As well as providing the alloy product with controlled amounts of alloying elements as described hereinabove, it is preferred that the alloy be prepared according to specific method steps in order to provide the most desirable characteristics of both strength and fracture toughness. Thus, the alloy as described herein can be provided as an ingot or billet for fabrication into a suitable wrought product by casting techniques currently employed in the art for cast products, with continuous casting being preferred. The ingot or billet may be preliminarily worked or shaped to provide suitable stock for subsequent working operations. Prior to the principal working operation, the alloy stock is preferably subjected to homogenization, and preferably at metal temperatures in the range of 900° to 1050° F. for a period of time of at least one hour to dissolve soluble elements such as Li and Cu, and to homogenize the internal structure of the metal. A preferred time period is about 20 hours or more in the homogenization temperature range. Normally, the heat up and homogenizing treatment does not have to extend for more than 40 hours; however, longer times are not normally detrimental. A time of 20 to 40 hours at the homogenization temperature has been found quite suitable. In addition to dissolving constituent to promote workability, this homogenization treatment is important in that it is believed to precipitate the Mn and Zr-bearing dispersoids which help to control final grain structure.

After the homogenizing treatment, the metal can be rolled or otherwise subjected to working operations to produce stock such as sheet or plate or other stock suitable for shaping into the end product. To produce a sheet or plate-type product, a body of the alloy is preferably hot rolled to a thickness ranging from 0.1 to 0.25 inch for sheet and 0.25 to 6.0 inches for plate. For hot rolling purposes, the temperature should be in the range of 1000° F. down to 750° F. Preferably, the metal temperature initially is in the range of 900° to 975° F.

When the intended use of a plate product is for wing spars where thicker sections are used, normally operations other than hot rolling are unnecessary. Where the intended use is wing or body panels requiring a thinner gauge, further reductions as by cold rolling can be provided. Such reductions can be to a sheet thickness ranging, for example, from 0.010 to 0.249 inch and usually from 0.030 to 0.10 inch.

If a clad material is being produced, the alloy material is first affixed to the ingot prior to the rolling steps. After rolling a body of the alloy to the desired thickness, the sheet or plate or other worked article is subjected to a solution heat treatment to dissolve soluble elements. The solution heat treatment is preferably accomplished at a temperature in the range of 900° to 1050° F. and produces either a recrystallized or an unrecrystallized grain structure.

Solution heat treatment can be performed in batches or continuously, and the time for treatment can vary from hours for batch operations down to as little as a few minutes for continuous operations. Basically, solution effects can occur fairly rapidly, for instance in as little as 30 to 60 seconds, once the metal has reached a solution temperature of about 950° to 1050° F. However, heating the metal to that temperature can involve substantial amounts of time depending on the type of operation involved. In batch treating a sheet product in a production plant, the sheet is treated in a furnace load and an amount of time can be required to bring the entire load to solution temperature, and accordingly, solution heat treating can consume one or more hours, for instance one or two hours or more in batch solution treating. In continuous treating, the sheet is passed continuously as a single web through an elongated furnace which greatly increases the heat-up rate. The continuous approach is favored in practicing the invention, especially for sheet products, since a relatively rapid heat up and short dwell time at solution temperature is obtained. Accordingly, the inventors contemplate solution heat treating in as little as about 1.0 minute. As a further aid to achieving a short heat-up time, a furnace temperature or a furnace zone temperature significantly above the desired metal temperature provides a greater temperature head useful in reducing heat-up times.

To further provide for the desired strength and fracture toughness necessary to the final product and to the operations in forming that product, the product should be rapidly quenched to prevent or minimize uncontrolled precipitation of strengthening phases referred to herein later. Thus, it is preferred in the practice of the present invention that the quenching rate be at least 100° F. per second from solution temperature to a temperature of about 200° F. or lower. A preferred quenching rate is at least 200° F. per second in the temperature range of 900° F. or more to 200° F. or less. After the metal has reached a temperature of about 200° F., it may then be air cooled. When the alloy of the invention is slab cast or roll cast, for example, it may be possible to omit some or all of the steps referred to hereinabove, and such is contemplated within the purview of the invention.

After solution heat treatment and quenching as noted herein, the improved sheet, plate or extrusion and other wrought products can have a range of yield strength from about 25 to 50 ksi and a level of fracture toughness in the range of about 50 to 150 ksi $\sqrt{in.}$ When the use of the sheet product is aircraft wing or body panels, the sheet product is first subjected to a thermal treatment prior to stretching and aging (sometimes referred to as preaging). It is this thermal treatment which is so important in the present invention in preventing any substantial development of Luder's lines during stretching or forming. This preaging treatment must be carried out at a temperature sufficiently low such that it does not degrade the properties of the sheet product after the final aging treatment. Thus, preferably, the preaging treatment is carried out at a temperature of less than 270° F. and greater than 150° F., e.g., 180° F. It is believed that for magnesium-containing aluminum-lithium alloys, the temperature can be even lower. For example, for AA2091, the temperature may be as low as 125° F. with longer times, e.g., over 50 hours and as high as 100 hours or more, being required. A suitable preaging temperature is in the range of 210° to 250° F. and typically at about 230° F. For example, time at the preaging temperature can be as low as 6 hours with typical times being greater than 18 hours.

In the case of sheet, for example, it is preferred that stretching to provide a flat product is less than 3% and typically in the range of about 1% to about 2%.

In some instances, it has been found that controlled cold working may be employed after solution heat treating and prior to the thermal treatment. For example, sheet or plate may be cold rolled to provide up to 5% reduction and preferably 3% or less, e.g., 1.0%.

After the alloy product of the present invention has been stretched, it may be artificially aged to provide the required combination of fracture toughness and strength. This can be accomplished by subjecting the sheet or plate to a temperature in the range of 150° to 400° F. for a sufficient period of time to further increase the yield strength. Some compositions of the alloy product are capable of being artificially aged to a yield strength as high as 95 ksi. However, the useful strengths are in the range of 45 to 85 ksi and corresponding fracture toughnesses are in the range of 100 to 25 ksi $\sqrt{in.}$ Preferably, artificial aging is accomplished by subjecting the alloy product to a temperature in the range of 275° to 375° F. for a period of at least 30 minutes. A suitable aging practice contemplate a treatment of about 8 to 24 hours at a temperature of about 325° F. Further, it will be noted that the alloy product in accordance with the present invention may be subjected to any of the typical underaging treatments well known in the art, including natural aging. Also, while reference has been made herein to single aging steps, multiple aging steps, such as two or three aging steps, are contemplated.

The following examples are further illustrative of the invention.

EXAMPLE 1

An aluminum alloy consisting of 2.2 wt. % Li, 2.6 wt. % Cu, 15 wt. % Zr, the balance essentially aluminum and impurities, was cast into an ingot suitable for rolling. The ingot was homogenized in a furnace at a temperature of 1000° F. for 24 hours and was subsequently hot rolled and cold rolled to 0.063 inch thick sheet. The sheet was then cut to a length and solution heat treated in a heat treating furnace for a 20 minute soak at 1020° F. and then quenched in 75° F. water. Following quench, all pieces were roller leveled to remove quench distortion. Four different finishing practices were then tried on the material. Two pieces were stretched 1.5% directly after leveling. Both pieces exhibited Luder's Lines. Four pieces were pre-aged for 24 hours at 230° F., air cooled and finished two ways. Two of these pieces were stretched 1.5% and showed no signs of Luder's Lines. The other two pieces were given a cold reduction of 1% and then stretched 0.5%. These also exhibited no Luder's Lines. The last finishing practice utilized a 0.75% cold reduction prior to the pre-age. These two pieces were then given the same pre-age practice and stretched 0.75%. No Luder's Lines were observed.

EXAMPLE 2

An aluminum alloy consisting of 2.3 wt. % Li, 2.7 wt. % Cu, 0.10 wt. % Zr, the balance essentially aluminum and impurities, was cast into an ingot suitable for rolling. The ingot was homogenized in a furnace at a temperature of 1000° F. for 24 hours and was subsequently hot rolled to 0.162 inch thick. Samples were then cut from the sheet and cold rolled to 0.063 inch thick sheet by 6 inch wide. Solution heat treatment was done in a heat treating furnace for 60 minutes soak at 1020° F. and then quenched in 75° F. water. Following quench, three pieces were stretched immediately at three different levels, 0.75%, 1.0% and 1.5%. All pieces exhibited Luder's Lines following the stretching operation. Two other pieces from the same heat treatment load were pre-aged at 230° F., one for 24 hours and one for 100 hours and air cooled. Both pieces were stretched 1.0%. The piece which was pre-aged for 24 hours showed only light or very slight Luder's Lines on one end. The piece which was pre-aged for 100 hours showed no Luder's Lines.

It will be appreciated that this thermal treatment can be applied to aluminum-lithium alloys, e.g., Aluminum Association (AA) alloys such as 2090, 2091, 8090, X8192, X8092 and 8091.

While the invention has been described in terms of preferred embodiments, the claims appended hereto are intended to encompass other embodiments which fall within the spirit of the invention.

What is claimed is:

1. A method of making aluminum base alloy flat rolled product substantially free of Luder's lines after stretching, the method comprising the steps of:

(a) providing a body of a lithium-containing aluminum base alloy;

(b) working said body to produce a flat rolled product;

(c) solution heat treating and quenching said flat rolled product;

(d) preaging said flat rolled product for a time and temperature which does not substantially affect final mechanical properties but which permits stretching said flat rolled product without formation of Luder's lines;

(e) stretching said preage flat rolled product; and (f) aging said product to a condition having a substantially stable level of mechanical properties.

2. The method in accordance with claim 1 wherein the preaging is carried out at a temperature in the range of 150° to 270° F.

3. The method in accordance with claim 1 wherein the preaging is carried out at a temperature in the range of 210° to 250° F.

4. The method in accordance with claim 1 wherein the product is preaged for at least 6 hours.

5. The method according to claim 1 wherein said product contains 0.5 to 4.0 wt. % Li, 0 to 5.0 wt. % Mg, up to 5.0 wt. % Cu, 0 to 1.0 wt. % Zr, 0 to 2.0 wt. % Mn, 0 to 7.0 wt. % Zn, 0.5 wt. % max., i.e., .5 wt. % max. Si, the balance aluminum and incidental impurities.

6. The method according to claim 2 wherein the product contains 1.0 to 4.0 wt. % Li.

7. The method according to claim 2 wherein the product contains 0.1 to 5.0 wt. % Cu.

8. The method according to claim 2 wherein said product contains 2.0 to 3.0 wt. % Li, 0.5 to 4.0 wt. % Cu, 0 to 3.0 wt. % Mg, 0 to 0.2 wt. % Zr and 0 to 1.0 wt. % Mn.

9. The method in accordance with claim 1 wherein said flat rolled product has a thickness of 0.010 to 0.249 inch.

10. The method in accordance with claim 1 wherein said flat rolled product is a clad product having a lithium-containing aluminum alloy core clad with an aluminum alloy suitable for protecting the core.

11. The method in accordance with claim 10 wherein the claimed product has a core of lithium-containing aluminum base alloy and a cladding of higher purity aluminum alloy than the core.

12. The method in accordance with claim 11 wherein the cladding on the core is selected from 1100, 1200, 1230, 1135, 1235, 1435, 1145, 1345, 1250, 1350, 1170, 1175, 1180, 1185, 1285, 1188, 1199 or 7072.

13. The method in accordance with claim 1 wherein the flat rolled product is a clad product having a core selected from 2090 or 2091.

14. The method in accordance with claim 13 wherein said core product has a cladding selected from 1100, 1200, 1230, 1135, 1235, 1435, 1145, 1345, 1250, 1350, 1170, 1175, 1180, 1185, 1285, 1188, 1199 or 7072.

15. The method in accordance with claim 1 wherein the solution heat treated flat rolled product is cold rolled to provide not more than a 5% reduction prior to step d.

16. A method of making an aluminum base alloy clad product substantially free of Luder Lines after stretching, the method comprising the steps of:

(a) providing a clad product having a thickness in the range of 0.010 to 0.249 inch and having a core selected from 2090 or 2091 and having a cladding on at least one side thereof selected from 1100, 1200, 1230, 1135, 1235, 1435, 1145, 1345, 1250, 1350, 1170, 1175, 1180, 1185, 1285, 1188, 1199 or 7072;

(b) solution heat treating and quenching said flat rolled product;

(c) preaging said flat rolled product for a time and temperature which does not substantially affect mechanical properties but which permits stretching said flat rolled product without formation of Luder's lines;

(d) stretching said preage flat rolled product; and (e) aging said product to a condition having a substantially stable level of mechanical properties.

17. A method of making aluminum base alloy flat rolled product substantially free of Luder's lines after stretching, the method comprising the steps of:

(a) providing a body of a lithium-containing aluminum base alloy consisting essentially of 0.5 to 4.0 wt. % Li, 0 to 5.0 wt. % Mg, up to 5.0 wt. % Cu, 0 to 1.0 wt. % Zr, 0 to 2.0 wt. % Mn, 0 to 7.0 wt. % Zn, 0.5 wt. % max. Fe, 0.5 wt. % max. Si, the balance aluminum and incidental impurities;

(b) working said body to produce a flat rolled product;

(c) solution heat treating and quenching said flat rolled product;

(d) preaging said flat rolled product for at least 6 hours at a temperature in the range of 200° to 270° F.;

(e) stretching said preage flat rolled product; and (f) aging said product to a condition having a substantially stable level of mechanical properties.

18. The method in accordance with claim 17 wherein the solution heat treated flat rolled product is cold rolled to provide not more than a 5% reduction prior to step (d).

19. A lithium-containing aluminum base alloy preaged stretched sheet product substantially free of Luder's Lines after stretching, the freedom from Luder's Lines resulting from preaging the sheet product prior to stretching.

20. The sheet product in accordance with claim 19 having an aluminum alloy cladding on at least one side thereof for protecting said sheet product.

* * * * *